US008163084B2

(12) United States Patent
Terada et al.

(10) Patent No.: US 8,163,084 B2
(45) Date of Patent: Apr. 24, 2012

(54) NANOSTRUCTURE AND MANUFACTURING METHOD FOR SAME

(75) Inventors: Yoshihiro Terada, Sakura (JP); Mitsuru Kamikatano, Sakura (JP); Kuniharu Himeno, Sakura (JP); Bunsho Ohtani, Sapporo (JP); Takamune Yamagami, Sapporo (JP); Tsukasa Torimoto, Sapporo (JP)

(73) Assignees: Fujikura Ltd., Tokyo (JP); National University Corporation Hokkaido University, Hokkaido (JP)

( * ) Notice: Subject to any disclaimer, the term of this patent is extended or adjusted under 35 U.S.C. 154(b) by 1198 days.

(21) Appl. No.: 11/938,541

(22) Filed: Nov. 12, 2007

(65) Prior Publication Data

US 2008/0075889 A1 Mar. 27, 2008

Related U.S. Application Data

(62) Division of application No. 11/207,748, filed on Aug. 22, 2005, now Pat. No. 7,524,370.

(30) Foreign Application Priority Data

Nov. 26, 2004 (JP) ..... 2004-343117

(51) Int. Cl.
*C30B 29/60* (2006.01)

(52) U.S. Cl. ..... 117/68; 117/69; 117/70; 117/940

(58) Field of Classification Search ..... 117/68, 117/69, 70, 940
See application file for complete search history.

(56) References Cited

U.S. PATENT DOCUMENTS

| | | | |
|---|---|---|---|
| 2005/0205830 | A1 | 9/2005 | Oles et al. |
| 2006/0017918 | A1 | 1/2006 | Cullum et al. |
| 2007/0100086 | A1 | 5/2007 | Hong et al. |

FOREIGN PATENT DOCUMENTS

| | | | |
|---|---|---|---|
| JP | 04-332131 | A | 11/1992 |
| JP | 05-082473 | A | 4/1993 |
| JP | 07-060109 | A | 3/1995 |
| JP | 07-507646 | A | 8/1995 |
| JP | 10-218700 | A | 8/1998 |
| JP | 2002-134325 | A | 5/2002 |
| JP | 2003-251599 | A | 9/2003 |
| JP | 2003-266400 | A | 9/2003 |
| JP | 2003-332561 | A | 11/2003 |
| JP | 2004-136377 | A | 5/2004 |
| JP | 2006-515418 | A | 5/2006 |
| WO | 94/22051 | A1 | 9/1994 |
| WO | 2004/020969 | A2 | 3/2004 |

OTHER PUBLICATIONS

Yamagami et al., "The 57$^{th}$ Divisional Meeting on Colloid and Surface Chemistry", the Chemical Society of Japan, Sep. 11, 2004.

Ohno et al., "Crystal faces of rutile and anatase $TiO_2$ particles and their roles in photocatalytic reactions", New J. Chem., 2002, 26, pp. 1167-1170.

*Primary Examiner* — Bob M Kunemund

(74) *Attorney, Agent, or Firm* — Sughrue Mion, PLLC

(57) ABSTRACT

The invention relates to nanostructure and its manufacturing method. In the manufacturing method of a nanostructure, first anisotropic crystalline particles, connectors having end to be connected to a specific crystal face of each of said crystalline particles, and second particles to be connected to the other end of each of said connectors are prepared. First ends of the connectors are connected to specific crystal faces of the first crystalline particles, and simultaneously or before or after the connection, the second ends of the connectors are connected to the second particles. A nanostructure formed by this method has a three-dimensional structure which does not have a closest packing structure.

13 Claims, 3 Drawing Sheets

NANOSTRUCTURE AND MANUFACTURING METHOD FOR SAME

This application is a divisional of application Ser. No. 11/207,748 filed on Aug. 22, 2005, issued Apr. 28, 2009 and now U.S. Pat. No. 7,524,370.

BACKGROUND OF THE INVENTION

1. Field of the Invention

The invention relates to a nanostructure as an advanced functional material having a nano sized structure, and a manufacturing method of the nanostructure.

Priority is claimed on Japanese Patent Application No. 2004-343117, filed Nov. 26, 2004, the content of which is incorporated herein by reference.

2. Description of the Related Art

As is widely known, under a size smaller than a specific value, thin films, thin wires, pores, and dots of a metal or a semiconductor exhibit, specific electronic, optical, and chemical properties. Based on that knowledge, a nanostructure of several ten to hundred nanometers in size is expected as an advanced functional material, and extensive study has been carried out on such a nanostructure (ex. Japanese Unexamined Patent Application, First Publication No. 2003-332561, Japanese Unexamined Patent Application, First Publication No. 2003-266400).

Japanese Unexamined Patent Application, First Publication No. 2003-332561 discloses a method of forming a functional material utilizing a peptide bond. In that method, a specific amino acid to which a nanostructure is selectively connected is integrated at a predetermined position of an array of amino acids of a peptide bond chain. By the stereo structure of the peptide bond, spatial arrangement of one or a plurality of nanostructures can be determined.

Japanese Unexamined Patent Application, First Publication No. 2003-266400 discloses a manufacturing method of a nano-structured silicon oxide including: (a) a process for preparing aluminum and silicon; (b) a process for forming, using a film formation method under a disequilibrium condition, a film-shape mixture of aluminum and silicon composed of 20-70 atomic % Si and valance Al and having a texture in which aluminum rods are surrounded by a silicon matrix region; and (c) a process for forming fine holes by anodizing the mixed film of aluminum and silicon.

These technologies are expected to be widely utilized not only in the field of chemistry, but also in the fields of medicine, pharmacy, biology, and other fields.

A manufacturing method of a nanostructure can be applied with a fine patterning technique used in semiconductor processing, such as photo lithography or electron beam radiation.

However, those prior arts require high manufacturing cost and cannot provide a high yield. In addition, manufacturing methods in the prior arts are based on a two-dimensional process and cannot be appropriately used in the mass production of three-dimensionally structured materials.

Therefore, novel nanostructures have been investigated by the use of an assembly of nano-sized particles arranged in accordance with the naturally formed systematic structure (self organized structure). However, a general process of self organization using isotropic particles only achieves a closest packing structure of fine particles.

SUMMARY OF THE INVENTION

Based on the above described consideration, the present invention aims to provide a nanostructure of a selective three-dimensional structure and manufacturing method suitable for mass production of such a nanostructure.

To attain the above described object, the invention provides a manufacturing method of a nanostructure by preparing: first anisotropic crystalline particles; connectors having end to be connected to a specific crystal face of each of the first crystalline particles; and second particles connected to the other end of each of the connectors, connecting first end of the connectors to specific crystal faces of the first crystalline particles, and simultaneously or with a before and after time difference, connecting second ends of the connector to surfaces of second particles, thereby forming a nanostructure with a three-dimensional structure which does not have a closest packing structure.

In the manufacturing method of a nanostructure, more than one species of anisotropic crystalline particles may be connected intervening the connectors.

In the manufacturing method of a nanostructure, specific crystal faces of the crystalline particles may be connected to non-crystalline particles intervening the connectors.

In the manufacturing method of a nanostructure, the connectors may be silane coupling agents.

In the manufacturing method of a nanostructure, metal particles may be attached onto specific crystal faces of the first anisotropic particles, thereby it can be used as at least portions of the connectors.

In the manufacturing method of a nanostructures, anisotropic crystalline particles may be decahedral titanium oxide particles.

The manufacturing method of a nanostructure may include: suspending decahedral titanium oxide particles in a metallic salt solution; irradiating ultraviolet light onto the solution; thereby depositing the metals on specific crystal faces of the decahedral titanium oxide particles, using the metals as at least portions of the connectors.

In the manufacturing method of nanostructures, metals contained in the metallic salt solution may be gold or platinum.

In the manufacturing method of a nanostructure, gold or platinum may be deposited on the crystal faces equivalent to the (101) planes of the decahedral titanium oxide particles.

In the manufacturing method of a nanostructure, a nanostructure of a linear chain connecting decahedral titanium oxide particles and silica particles intervening the connectors may be obtained by depositing gold on the crystal faces corresponding to (101) planes of the decahedral titanium oxide particles, using 3-mercaptopropyltrimethoxysilanes as the connectors, connecting first ends of the connectors with the gold, and connecting second ends of the connector to silica particles, thereby forming a nanostructure The invention provides a nanostructure having: first anisotropic crystal particles; connectors first ends of which are connected to specific crystal faces of the first anisotropic crystalline particles; second particles connected to second ends of the connectors; and the nanostructure has a three-dimensional structure which does not have a closest packing structure.

The nanostructure may have a structure in which more than one species of anisotropic particles are connected intervening the connector.

The nanostructure may have a structure in which specific crystal faces of crystalline particles and amorphous particles are connected intervening the connectors.

The connectors used in the nanostructure may be silane coupling agents.

At least portions of the connectors may be made of metallic particles attached on the specific crystal faces of anisotropic crystalline particles.

The invention provides a nanostructure manufactured by the above-described manufacturing method.

The invention provides a three-dimensional nanostructure which does not have a closest packing structure.

The manufacturing method of the invention may be used to mass produce three-dimensional nanostructures which does not have a closest packing structure at a low cost.

DETAILED DESCRIPTION OF THE INVENTION

Figure 1A:
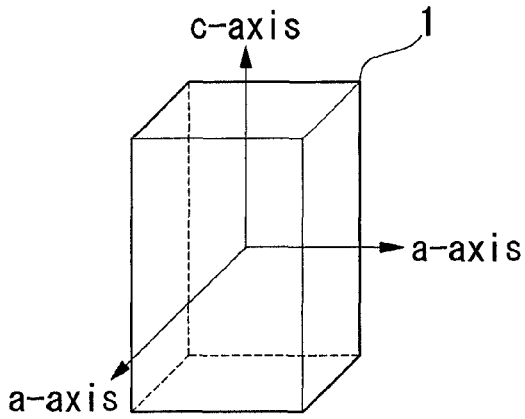
FIG. 1A is a perspective drawing showing axial-directions of a hexahedral particle as an example of a crystalline particle of the invention.
Figure 1B:
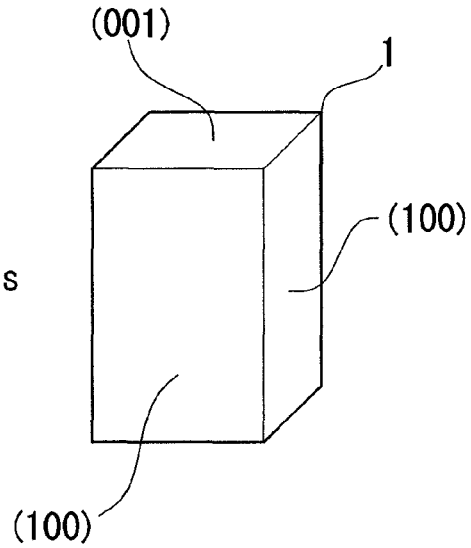
FIG. 1B is a perspective drawing showing each crystal face of a hexahedral particle as an example of a crystalline particle of the invention.

The invention provides a novel three-dimensional nanostructure having a selective structure which does not have a closest packing structure, using a naturally formed systematic structure (self-organized structure) of nano-sized particles, and further utilizing anisotropy of the crystalline particles.

The manufacturing method of a nanostructure of the invention includes:

preparing first anisotropic crystalline particles, connectors having end to be connected to a specific crystal face of each of the crystalline particles, and second particles to be connected to the other end of each of the connectors;

connecting first ends of the connectors to the specific crystal faces of the crystalline particles; and simultaneously or with a before and after time difference, connecting second ends of the connectors to surfaces of said second particles; thereby forming a nanostructure having a three-dimensional structure which does not have a closest packing structure.

In the above described manufacturing method of a nanostrucuture, each one of first crystalline particles may be connected to second particles intervening two or more connectors. A plurality of particles may be connected to form a linking intervening the connectors.

The first anisotropic crystalline particles in the manufacturing method of a nanostructure may be selected from crystalline particles of various materials including metals such as Si, metallic alloys, inorganic compounds (salt, metallic compound, oxide, nitride, carbide etc.), and organic compounds. One or more species selected from the above described materials may be used as the first anisotropic crystalline particles in the manufacturing method. Crystals having some isotropic physical properties such as optical isotropy may also be used in the manufacture of the nanostructure provided that the crystals have anisotropic crystalline forms. There is no limitation on the sizes of the crystalline particles. It is preferable to use crystalline particles of 1 to 1000 nm in seize.

According to their symmetrical system, crystalline particles have various forms such as tetrahedron, hexahedron, octahedron, decahedron, and dodecahedron. Since different faces of a crystalline polyhedron have different chemical potential, reactivity to a reactive group is different among symmetrically different crystal faces. Therefore, a specific reactive group has a tendency of being bonded selectively to a specific face of a crystal.

Even when the crystalline particles have slightly deformed forms, or have slightly rough surfaces, the particles may be applied to the invention provided that the crystalline particles have substantially polyhedral forms and their crystalline faces may react with the reactive group of the connector.

The second particles used in the manufacturing method of the nanostructure may be selected from similar species of crystalline particles, different species of crystalline particles, non-anisotropic crystalline particles, and amorphous particles. One or more species of particles selected from the above described materials may be used in the manufacture of the nanostructure. There is no limitation in the particle size of the second particles. It is preferable to use particles of 1 to 1000 nm in size.

The connectors used in the manufacturing method of the nanostructure may be selected from various materials provided that the connectors can connect the specific crystal faces of first crystalline particles and second particles. Accordingly materials having various reactive groups can be used in accordance with the properties of the first crystalline particles and second particles. For example, it is possible to use connectors having first reactive group selectively bonding to specific crystal faces of each of first crystalline particle at one end, and a second reactive group being capable of being bonded to the surface of second particles at the other end.

For example, as connectors having such a first and second reactive group, silane coupling agents or the like may be selected. Some of the silane coupling agents can connect an inorganic and organic material, both of which are usually difficult to be connected. By using such an agent, a novel nanostructure can be produced.

As the reactive group having chemical bonding with the inorganic material such as glass, metal, and sand, a methoxy group and ethoxy group may be cited. As the reactive group chemically bonding with the organic material such as synthetic resins, a vinyl group, epoxy group, amino group, methacryl group, mercapto group can be cited.

Plating, deposition, or the like may attach metallic particles to the specific crystal faces of a crystalline particles. Such metallic particles can be used as connectors, or as portions of the connectors, thereby connectors having at least portions of the metallic particles are formed. The deposition mechanism and deposits of metallic particles or the like are not limited. For example, in the case of forming deposits of gold or platinum on the crystal faces of titanium oxide particles ($TiO_2$) as optical semiconductors, metallic particles can be deposited on the specific crystal faces by dipping the titanium oxide particles in a solution containing Au, for example gold chloride or the like, and subsequently irradiating ultraviolet light onto the solution to reduce the gold chloride to form metallic gold. By having the metallic particles bonded with reactive groups of connectors such as silane coupling agents connected to second particles, nanostructures are formed, in each of which the crystalline particles and another particles are connected intervening the metallic particles and the connectors.

In the manufacturing method of the nanostructure, where the nanostructure is manufactured by connecting the anisotropic crystalline particles and non-anisotropic crystalline particles or amorphous particles, a specific three-dimensional structure can be obtained by selecting the sizes of the particles to be connected.

An embodiment of the invention is explained in the following with reference to the drawings.

Figure 2A:
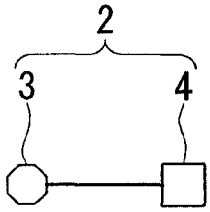
FIG. 2A is a drawing schematically exemplifying a structure of a connector used in the invention.
Figure 2B:
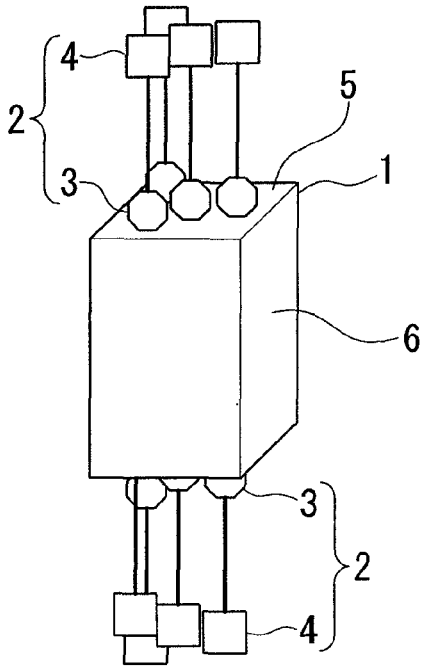
FIG. 2B is a drawing schematically exemplifying a state in which first reactive groups of the connectors are bonded to specific crystal faces of a hexahedral crystalline particle.
Figure 3A:
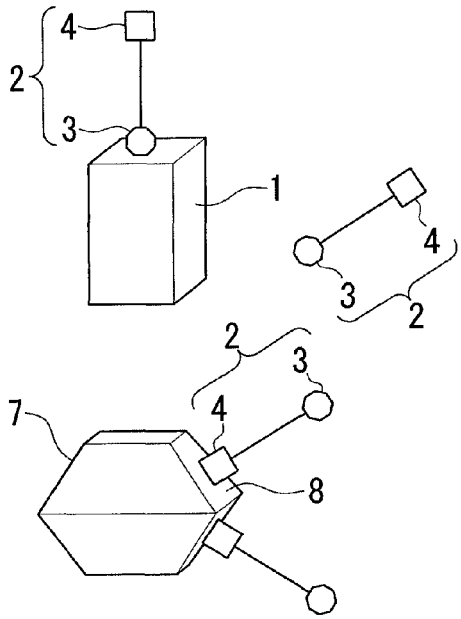
FIG. 3A is a drawing schematically showing a state in which connectors are connected to each particle in the manufacturing method of the invention.
Figure 3B:
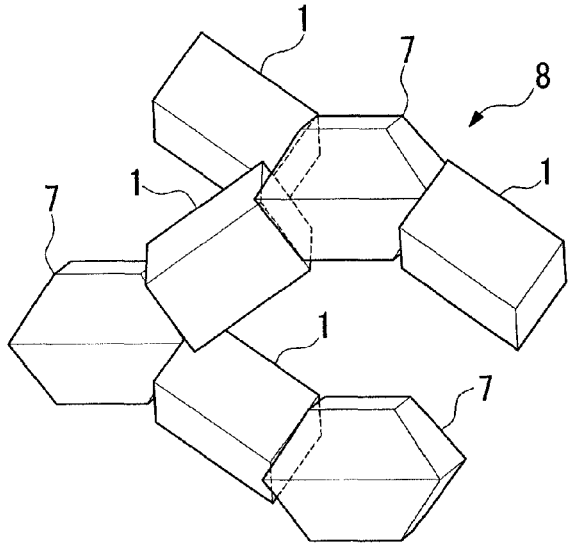
FIG. 3B is a perspective drawing exemplifying a nanostructure used in the manufacturing method of the invention.

FIGS. 1A through 3B are drawings explaining an embodiment of the invention. FIG. 1A is a perspective drawing showing axial-directions of a hexahedral particle 1. FIG. 1B is a perspective drawing showing crystalline faces of the hexahedral particle 1. FIG. 2A schematically exemplifies a structure of a connector. FIG. 2B schematically exemplifies a state in which first reactive groups 3 of the connectors 2 are bonded to specific crystal faces 5 of the hexahedral crystalline particle 1. FIG. 3A schematically shows a state in which connectors 2 are connected to each of the hexahedral particle 1 and decahedral particle 7. FIG. 3B is a perspective drawing exemplifying a nanostructure 8 obtained in the embodiment.

This embodiment uses hexahedral crystalline particles 1 one of which is shown in FIGS. 1A and B as first anisotropic crystalline particles, and uses decahedral crystalline particles 7 one of which is shown in the bottom of FIG. 3A as second particles. The connectors 2 used in the embodiment have the first reactive groups 3 at first ends and second reactive groups 4 at second ends. The first reactive groups 3 selectively bonded to specific crystal faces of the hexahedral crystalline particles 1; and the second reactive groups 4 selectively bonded to specific crystal faces of the decahedral crystalline particles 7. The hexahedral crystalline particles 1 and the decahedral crystalline particles 7 are connected intervening the connectors 2, thereby a three-dimensional nanostructure 8 is formed as shown in FIG. 3B.

The hexahedral crystalline particles 1 belonging to the tetragonal system have rectangular solid shape. As shown in FIGS. 1A and B their crystalline surfaces comprise two types of crystal faces each of which is symmetrically equivalent to the (001) plane or (100) plane respectively. Since the chemical potential is different among different crystal planes, reactivity of the crystal faces to a reactive group is also different. Therefore, the specific reactive groups are selectively bonded to the specific crystal faces 5.

FIG. 2A shows one of the connectors 2 having at first end a first reactive group 3 selectively bonded to the specific crystal faces 5 of the hexahedral crystalline particle 1. When the connectors 2 are reacted with the hexahedral crystalline particles 1, as shown in FIG. 2B, the first reactive groups 3 are bonded only to the specific crystal faces 5 of the hexahedral crystalline particles 1, and other crystal faces 6 are not bonded with the first reactive groups 3. When the bonding utilizing the reactive group is applied to the connection of crystals, a nanostructure in which crystals are connected by predetermined crystal faces can be obtained.

As shown in FIG. 3A, when the connectors 2 have the first reactive groups 3 selectively bonding with the specific crystal faces 5 on the hexahedral crystalline particle 1 at first ends, and the second reactive group 4 selectively bonding with the crystal faces 8 of the decahedral crystalline particle 7 at the second ends, by having the connectors 2 be reacted with the hexahedral crystalline particles 1 and decahedral crystalline particles 7 simultaneously or with a time interval, as shown in FIG. 3B, it is possible to obtain the three-dimensional nanostructure 8 that does not have a closest packing structure, in which specific crystal faces of the hexahedral crystals and specific crystal faces of the decahedral crystals are connected with each other intervening the connectors 2.

In this manufacturing method, by forming a connectors 2 with preferable reactive groups, it is possible to select an orientation of the crystal faces to which the connectors 2 are connected. By selecting the first crystalline particles, or the first crystalline particles and second particles, a novel three-dimensional nanostructure that does not have a closest packing structure can be selectively obtained.

In this manufacturing method, by a simple process such as a simple chemical reaction, crystalline particles or the crystalline particles and another particles can be connected. Therefore it is possible to manufacture at low cost and high production rate a novel three-dimensional nanostructure that does not have a closest packing structure.

A second embodiment of the invention is explained in the following.

In this embodiment, decahedral titanium oxide particles are used as the first anisotropic crystalline particles, and silica particles are used as the second particles. Connectors are formed of a deposit of gold particles on specific faces of a decahedral titanium oxides, and silane coupling agents. As the silane coupling agents, for example, it is possible to use a 3-mercaptopropyltrimethoxysilane having a mercapto group capable of being bonded to gold, and a methoxy group capable of being bonded to the surface of the silica particle.

In the present embodiment, firstly, gold particles are deposited on the crystal faces equivalent to the (101) plane of the decahedral titanium oxide. This process can be performed using a simple chemical reaction. For example, after having suspended the decahedral titanium oxide particles in a gold chloride solution, by ultraviolet irradiation of the suspension, it is possible to deposit gold particles on the faces equivalent to the (101) plane of the decahedral titanium oxide. After the subsequent separation, gold-bearing decahedral titanium oxide particles can be obtained.

On the other hand, the surface of the silica particles are modified with the above-described silane coupling agents. By this surface modification, methoxy groups of the silane coupling agents are bonded to the surface of the silica particles, thereby forming silica particles the surfaces of which are connected with the silane coupling agents having mercapto groups in a free state.

Next, the gold-bearing decahedral titanium oxide particles and surface-modified silica particles are mixed with each other in a solution, thereby the mercapto groups on the silica surfaces and gold deposits on the specific crystal faces of the decahedral titanium oxide particles can be connected. After the separation of the particles from the solution, and if it is needed, after the drying process, nanostructures are obtained in which decahedral titanium-oxide particles are connected to the silica particles.

This embodiment also has the beneficial effect described in the first embodiment.

Example 1

Figure 4:
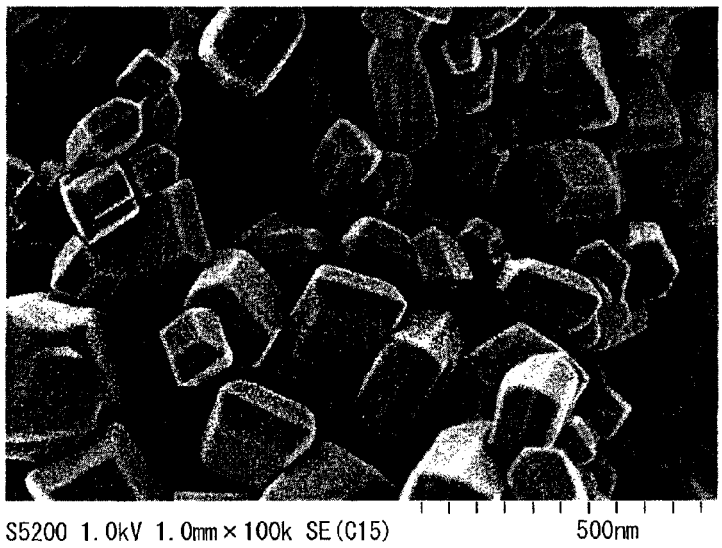
FIG. 4 is a SEM (Scanning Electron Microscope) image of crystalline particles used in the invention.

Decahedral titanium oxide particles shown in FIG. 4 were synthesized by a CVD method using titanium tetrachloride as a raw material. Titanium oxide belongs to an tetragonal system, and the crystal surface forming a decahedron comprises square faces equivalent to the (001) plane and trapezoidal faces equivalent to the (101) plane. In the following description, the term (101) planes represents crystal faces equivalent to the (101) plane. Average particle size of the decahedral titanium oxide was 100 nm.

Figure 5:
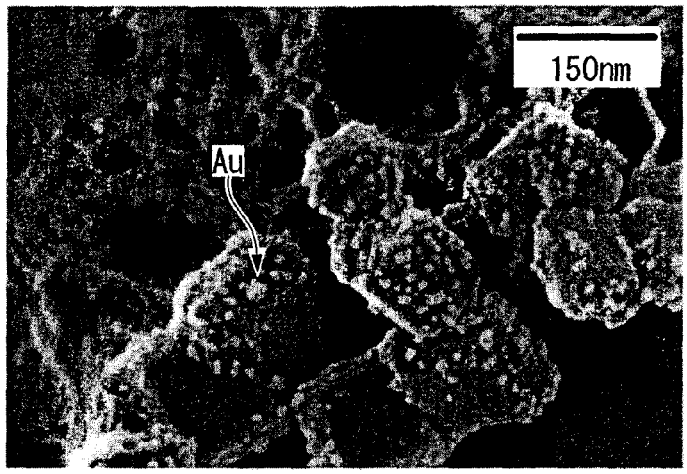
FIG. 5 is a SEM image of gold-bearing crystalline particles produced in the example.

Next, the decahedral titanium oxide particles were dispersed in a 2-propanol solution containing gold chloride acid. After photo radiation of the solution using a high pressure mercury vapor lamp, about 20% of gold was photo-deposited on the surface of the decahedral titanium oxide particles. A few drops of solution were dried on a slide glass, and were subsequently observed by a Scanning Electron Microscope as shown in FIG. 5.

The result of SEM observation shows that gold particles are mainly deposited on the (101) planes of the decahedral titanium oxide particles. That indicates a reduction of gold by a photochemical reaction selectively occurring on the (101) planes of the decahedral titanium oxide particles.

Example 2

Silica particles having spherical shapes of approximately 500 nm in seize were prepared from a commercial product. The surface of the silica particles were modified with silane coupling agents (3-mercaptopropyltrimethoxysilane). After the modification, the methoxy groups of the silane coupling agents were connected to the silica surfaces, and the silica particles had mercapto groups on their surfaces.

Figure 6A:
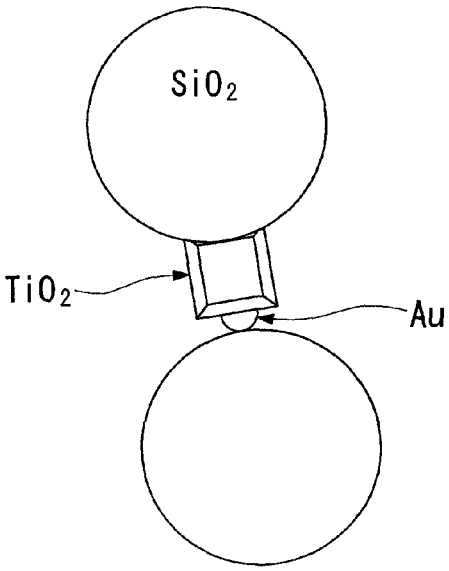
FIG. 6A is a schematic drawing of a nanostructure produced in the example.
Figure 6B:
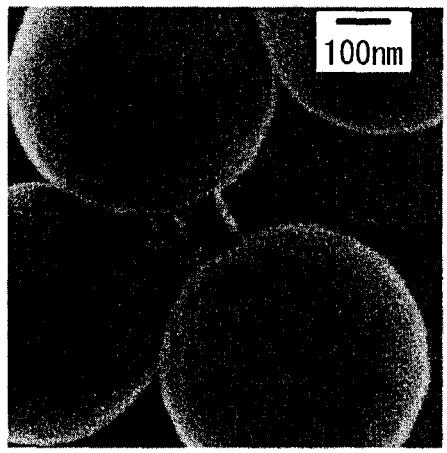
FIG. 6B is a SEM image of nanostructures produced in the example.

Next, the silica particles were added to the solution in which gold-bearing decahedral titanium oxide particles prepared in the Example 1 were dispersed. Nanostructures were formed after agitating the solution. A schematic drawing and SEM image of the nanostructure obtained after the agitation are shown in FIGS. 6A and B.

The result of SEM observation confirmed that spherical silica particles are connected to the (101) planes of the decahedral titanium oxide particles. Thus the formation of the nanostructure can be explained by the selective bonding of mercapto groups and photo deposit of gold particles on the (101) planes of the decahedral titanium oxide particles. In this case, the nanostructure only exhibits a straight chain-linkage. Such an occurrence of the nanostructure can be explained by the following. Since the silica particles have relatively larger particle size than that of the decahedral titanium oxide particles, morphological repulsion disturbs the connection of two silica particles to the adjacent (101) plane of a decahedral titanium oxide.

Comparative Example 1

Decahedral titanium oxide particles used in Example 1 and spherical silica particles used in Example 2 were dispersed in a 2-propanol solution. A few drops of the solution were dried on a glass plate and subsequently observed by SEM. Aggregates of decahedral titanium oxide particles and aggregates of spherical silica particles separated from each other. Aggregates of spherical silica showed closest packing structures, whereas decahedral titanium oxide particles were randomly aggregated.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A manufacturing method of a nanostructure comprising:

preparing first anisotropic crystalline particles, connectors having end to be connected to a specific crystal face of each of said crystalline particles, and second particles to be connected to the other end of each of said connectors;

connecting first ends of said connectors to the specific crystal faces of said crystalline particles, and connecting second ends of said connectors to surfaces of said second particles;

thereby forming a nanostructure having a three-dimensional structure which does not have a closest packing structure.

2. A manufacturing method of a nanostructure according to claim 1, wherein more than one species of crystalline particles are connected intervening said connectors.

3. A manufacturing method of a nanostructure according to claim 1, wherein specific crystal faces of first anisotropic crystalline particles are connected to non-crystalline particles intervening said connectors.

4. A manufacturing method of a nanostructure according to claim 1, wherein said connectors connected to said first anisotropic crystalline particles are silane coupling agents.

5. A manufacturing method of nanostructure according to claim 1, wherein at least portions of said connectors are metal particles attached on said specific crystal faces of first anisotropic crystalline particles.

6. A manufacturing method of a nanostructure according to claim 1, wherein said first anisotropic crystalline particles are decahedral titanium oxide particles.

7. A manufacturing method of a nanostructure according to claim 6 comprising:

suspending said decahedral titanium oxide particles in a metallic salt solution;

irradiating ultraviolet light onto said solution;

thereby depositing metal particles on specific crystal faces of said decahedral titanium oxide particles; and using said metal particles as at least portions of said connectors.

8. A manufacturing method of a nanostructure according to claim 7 wherein a metal contained in said metallic salt solution is selected from a group comprising gold and platinum.

9. A manufacturing method of a nanostructure according to claim 8 wherein said metal particles composed of a metal selected from a group comprising gold and platinum are deposited on crystal faces equivalent to the (100) planes of said decahedral titanium oxide particles.

10. A manufacturing method of a nanostructure according to claim 9 comprising:

depositing gold particles on crystal faces equivalent to the (101) planes of said decahedral titanium oxide particles;

using 3-mercaptopropyltrimethoxysilanes as said connectors;

connecting first ends of said connectors to said gold particles;

connecting second ends of said connectors to surfaces of a silica particles as second particles;

thereby forming a three-dimensional nanostructure of a linear linking of decahedral titanium oxide particles and silica particles intervening connectors.

11. A manufacturing method of a nanostructure according to claim 1, wherein said connectors are connected to said another particles before being connected to said first anisotropic crystalline particles.

12. A manufacturing method of a nanostructure according to claim 1, wherein said connectors are simultaneously connected to said first anisotropic crystalline particles and said second particles.

13. A manufacturing method of a nanostructure according to claim 1, wherein said connectors are connected to said second particles after being connected to said anisotropic crystalline particles.

* * * * *